US008550423B2

(12) United States Patent
Taylor et al.

(10) Patent No.: US 8,550,423 B2
(45) Date of Patent: Oct. 8, 2013

(54) DECORATION HANGER

(75) Inventors: Oliver Peter John Taylor, Warwickshire (GB); Matthew James Stokes, Northamptonshire (GB)

(73) Assignee: Ready 2 Go Limited, Northamptonshire (GB)

( * ) Notice: Subject to any disclaimer, the term of this patent is extended or adjusted under 35 U.S.C. 154(b) by 382 days.

(21) Appl. No.: 12/814,689

(22) Filed: Jun. 14, 2010

(65) Prior Publication Data

US 2010/0314512 A1 Dec. 16, 2010

(30) Foreign Application Priority Data

Jun. 12, 2009 (GB) ..... 0910065.2

(51) Int. Cl.
*A47G 29/00* (2006.01)

(52) U.S. Cl.
USPC ..... 248/683; 248/690

(58) Field of Classification Search
USPC ..... 248/683, 690, 467, 489, 205.3; 40/661.09, 671; 269/3, 6, 95; 29/270, 29/278, 277, 242, 271; 81/3.05, 3.27, 81/3.07; 428/343, 346, 352, 353, 354, 428/355 R, 411.1, 458; 156/106, 247, 275.3, 156/275.7, 305, 307.3, 302.4
See application file for complete search history.

(56) References Cited

U.S. PATENT DOCUMENTS

| | | | | |
|---|---|---|---|---|
| 3,869,333 | A * | 3/1975 | McMaster | 428/56 |
| 5,301,392 | A | 4/1994 | Richman | |
| RE36,258 | E * | 7/1999 | Coward et al. | 248/683 |
| 6,206,334 | B1 * | 3/2001 | Weck et al. | 248/467 |
| 6,350,502 | B1 * | 2/2002 | Grosskopf et al. | 428/40.1 |
| 6,769,541 | B1 * | 8/2004 | Carriere | 206/348 |
| 7,004,441 | B1 * | 2/2006 | Rutland | 248/690 |
| 7,487,872 | B2 * | 2/2009 | Curtsinger et al. | 206/349 |
| 2002/0100856 | A1 * | 8/2002 | Hatton | 248/683 |

FOREIGN PATENT DOCUMENTS

| | | |
|---|---|---|
| GB | 2379619 | 3/2003 |
| GB | 2433446 | 6/2007 |
| GB | 2447608 | 9/2008 |

OTHER PUBLICATIONS

Extended European Search Report.

* cited by examiner

*Primary Examiner* — Alfred J Wujciak
(74) *Attorney, Agent, or Firm* — Ice Miller LLP

(57) ABSTRACT

An exemplary decoration hanger of the present disclosure comprises a mounting portion having an adhering surface, and a clamp portion attached to the mounting portion, the clamp portion comprising a mouth configured to receive a part of a decoration and a tongue resiliently biased towards the mouth to retain a part of a decoration in use.

11 Claims, 6 Drawing Sheets

DECORATION HANGER

PRIORITY

The present U.S. nonprovisional application is related to, and claims the priority benefit of, UK Patent Application Ser. No. 0910065.2, filed Jun. 12, 2009, the contents of which are hereby incorporated by reference in their entirety into this disclosure.

BACKGROUND

The disclosure of the present application provides a decoration hanger. More specifically, the present disclosure provides an adhesive tag decoration hanger for balloons, tinsel, fairy lights and the like.

It is often desirable to hang decorations such as balloons, tinsel, fairy lights and the like in fixed positions on walls, ceilings, doors and the like for decorative effect. Previously, this has been achieved by the use of string, pins or adhesive tapes. Such methods are problematic; string requires an object to tie to, pins can damage surfaces and it is difficult to keep adhesive tape attached to both the decoration and the wall simultaneously. This is particularly true of balloons because the tied neck of the balloon often does not project very far from the balloon body, making it difficult and awkward to use as an anchor point.

Accordingly, it would be desirable to have a decoration hanger that overcomes these problems in the prior art. It is an aim of the present disclosure to provide an improved decoration hanger.

BRIEF SUMMARY

The disclosure of the present application provides various embodiments of decoration hangers.

According to a first aspect of the present disclosure, there is provided a decoration hanger comprising: a mounting portion having an adhering surface, and a clamp portion attached to the mounting portion, the clamp portion comprising a mouth configured to receive a part of a decoration.

Preferably the clamp portion is generally planar and the tongue is movable out of, and resiliently biased towards, the plane of the clamp portion.

Preferably the mouth comprises a slit running from an edge of the mounting portion to an orifice configured to receive the decoration. More preferably the tongue is formed from material cut to form the orifice. More preferably the orifice has a curved perimeter. More preferably the curved perimeter runs from the slit through at least a 90 degree angle. More preferably the curved perimeter runs from the slit through an approximately 270 degree angle.

Preferably the slit and the edge are joined by opposed curved edge portions.

Preferably the clamp portion has a higher flexural stiffness than the mounting portion. Preferably the clamp portion is thicker than the mounting portion. More preferably the hanger is constructed from a first sheet of material, in which the clamp portion is laminated with a second sheet of material.

Preferably the hanger comprises a film hinge between the mounting portion and the clamp portion.

Preferably the mouth extends from an edge of the clamp portion opposite the mounting portion. More preferably the mouth extends less than 75% of the distance from the edge to the clamp portion. More preferably the mouth extends less than 65% of the distance from the edge to the clamp portion.

Preferably the mounting portion has a length in the direction of the clamp portion, and a width in a direction perpendicular to the length, in which the width is higher than the length. More preferably the mounting portion is substantially elliptical.

According to at least one embodiment of the present disclosure, there is provided a method of manufacturing a decoration hanger comprising the steps of providing a film material having an adhering surface, cutting the film material to form a mounting portion and a clamp portion, and cutting the clamp portion to form a mouth and a tongue formed from mouth material.

Preferably the method comprises the step of reinforcing the clamp portion by affixing a further layer of sheet material thereto.

Preferably the method comprises the steps of providing a backing material, sandwiching the reinforcing layer of sheet material between the film material and the backing material, cutting at least the film material and the further layer of sheet material such that the clamp portion is formed coincident with the further layer of sheet material.

According to at least one embodiment of the present disclosure, there is provided decoration hanger comprising a mounting portion having an adhering surface, and a decoration attachment portion attached to the mounting portion, the decoration attachment portion comprising a formation configured to receive a decoration wherein the decoration attachment portion has a higher flexural stiffness than the mounting portion.

Preferably the clamp portion is thicker than the mounting portion. More preferably the hanger is constructed from a first sheet of material, in which the clamp portion is laminated with a second sheet of material.

BRIEF DESCRIPTION OF THE DRAWINGS

An exemplary decoration hanger will now be described with reference to the accompanying drawings in which.

DETAILED DESCRIPTION

Figure 1:
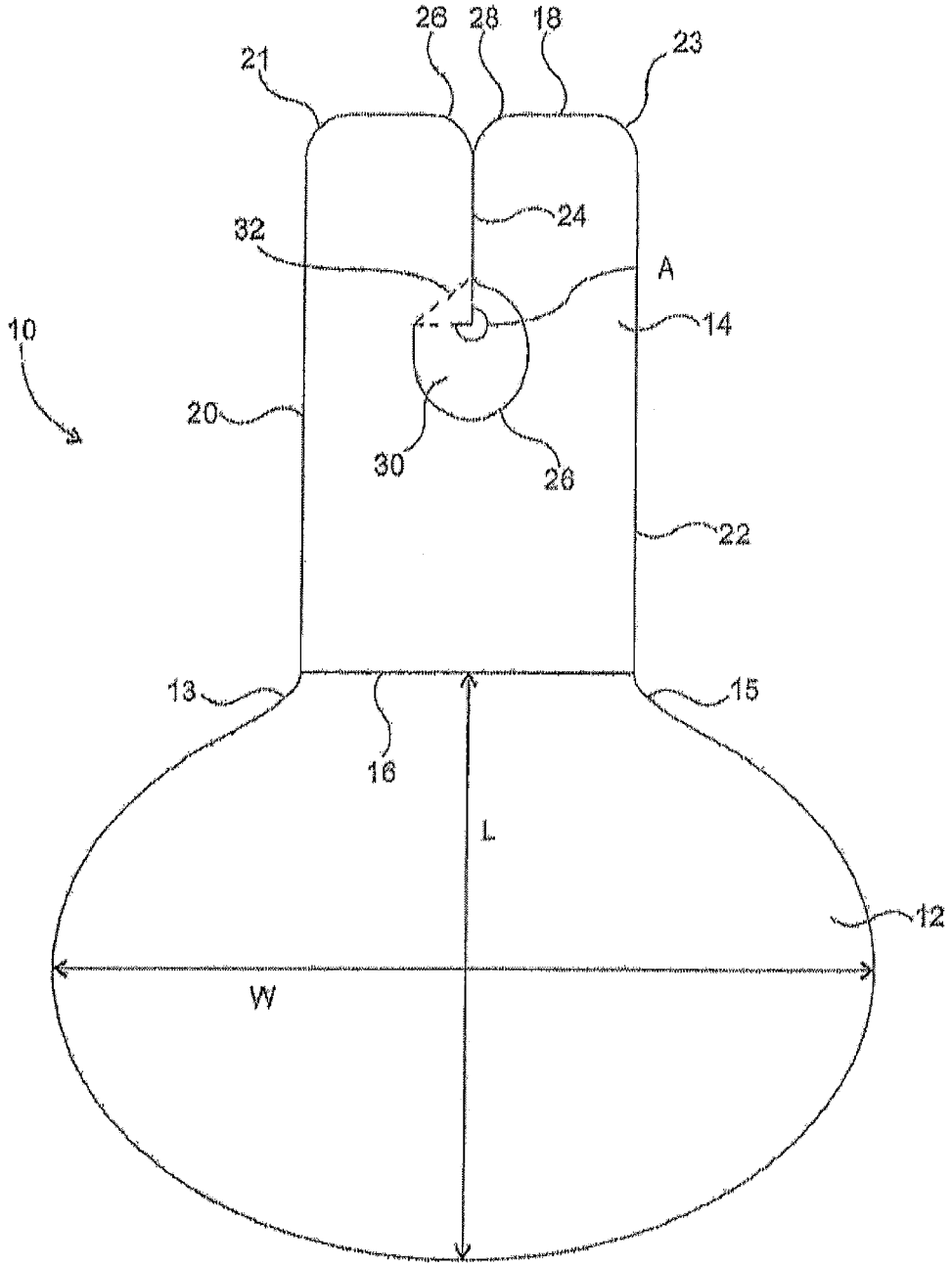
FIG. 1 is a top view of a decoration hanger in accordance with the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Referring to FIG. 1, a decoration hanger 10 comprises a mounting portion 12 and a clamp portion 14. The hanger 10 is constructed from a textured film plastics material. Texturing the material aids tactility as well as reducing reflections to make the hanger more aesthetically pleasing. The clamp portion 14 comprises a reinforced semi-rigid plastics material layer laminated to the film plastics material which terminates at a border 16 with the mounting portion.

The mounting portion 12 is generally elliptical having a width W and a length L. The length L is less than the width W. One side of the mounting portion 12 is coated with a reusable, semi-removable, clean peel, non-marking or damaging rubber or acrylic or silicone based adhesive. The mounting portion 12 and the clamp portion 14 are joined by curved shoulders 13, 15 to define a smooth transition therebetween. This helps to prevent stress concentrations and tearing in the material.

The clamp portion is generally rectangular and comprises an end edge 18 opposite the border 16 and a pair of parallel side edges 20, 22. A slit 24 extends from the edge 18, the slit 24 and end edge 18 being joined by a pair of opposed, filleted edges 26, 28.

The end edge 18 and the side edges 20, 22 are joined by fillets 21, 23.

The slit 24 terminates in a curved cut 26 which describes an incomplete ellipse with an internal angle A of 270 degrees. The ellipse is oriented with its long axis in the direction of the slit and the mounting portion. The cut 26 forms a mouth 29 (see FIGS. 3 and 4). A tongue 30 is created from the material of the mouth 29, and can move out of the plane of the clamp portion 14 along a hinge line 32. The stiffness of the material from which the hanger 10 is created means that the tongue 30 tends to resile back towards the mouth 29.

The cut 26 (and therefore the mouth 29) extends over 50 percent of the clamp portion 14 towards the border 16.

Figure 3:
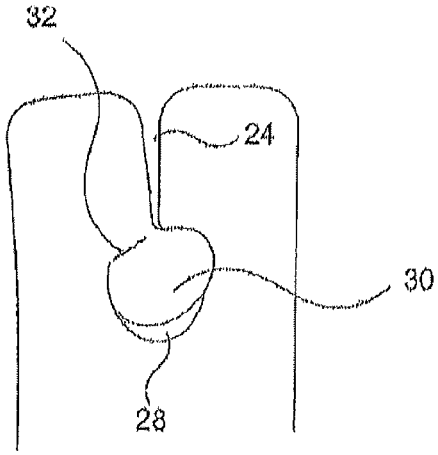
FIG. 3 is a top view of the decoration hanger of FIG. 1 separating.
Figure 4:
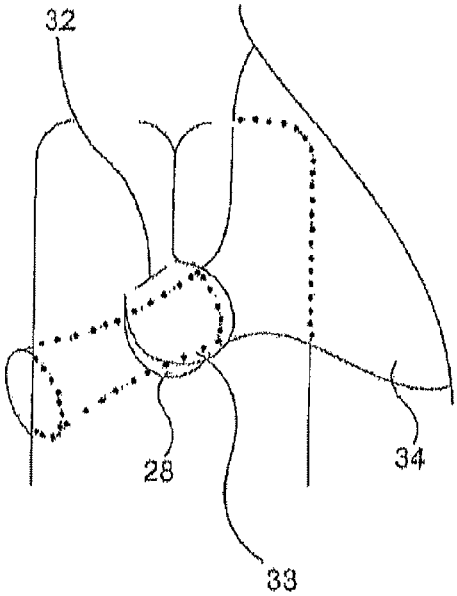
FIG. 4 is a top view of the clamping action of the decoration hanger of FIG. 1.

In use, a neck 33 of a balloon 34 can be slid through the slit 24 to pass through the mouth 29, as shown in FIG. 4. The slit 24 can be separated as shown in FIG. 3 to aid insertion. The presence of the neck 33 forces the tongue 30 to primarily elastically rotate about the hinge line 32. Due to the stiffness of the reinforced clamp portion 14, the tongue attempts to resile back into the mouth 29. In doing so, it clamps the balloon neck 33 in place.

Figure 11:
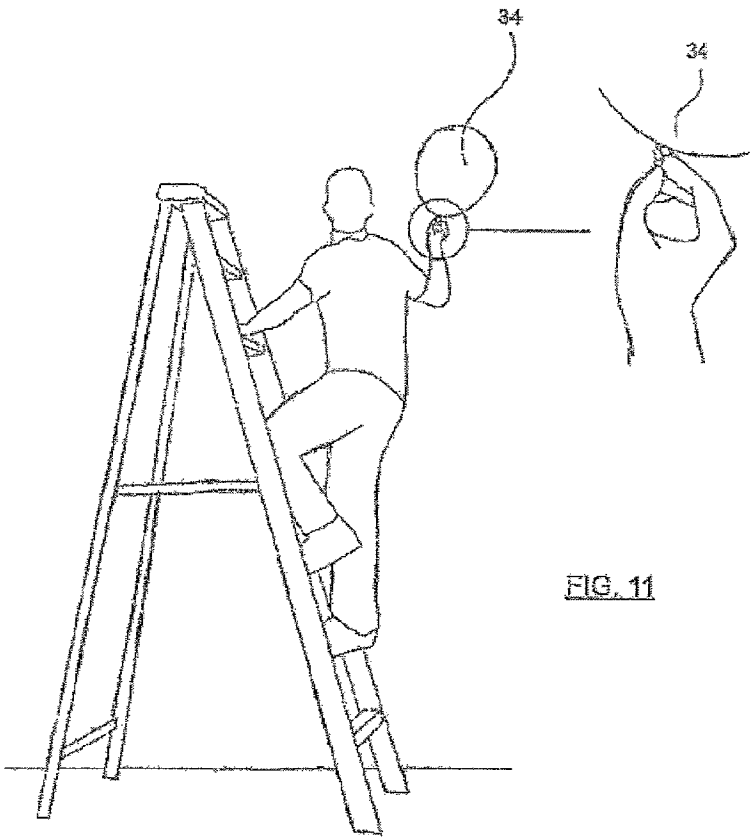
FIG. 11 is a perspective view of a user hanging the hanger of FIG. 1.
Figure 10:
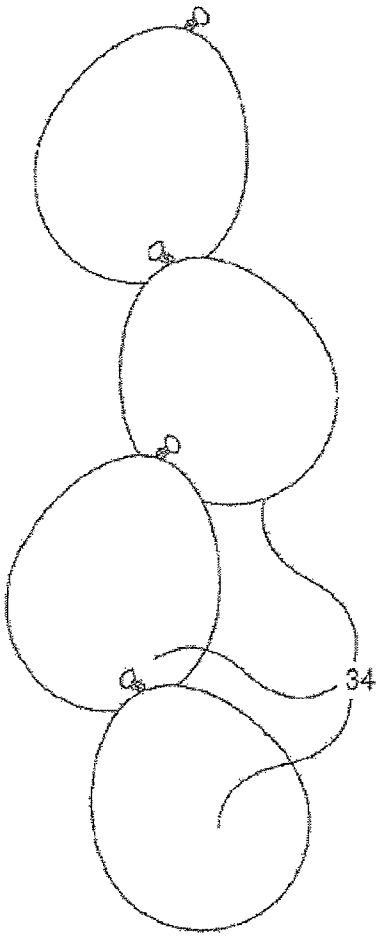
FIG. 10 is a perspective view of a number of balloons held together by several of the decoration hangers of FIG. 1.

Once clamped, the mounting portion 12 can be affixed to an object to hang the balloon 34 in place. As shown in FIG. 10, the hanger can be used to hang several balloons 34 together. It will be noted that because the balloon is clamped to the hanger, the hanger can be held and hung with a single hand, as shown in FIG. 11.

Figure 2:
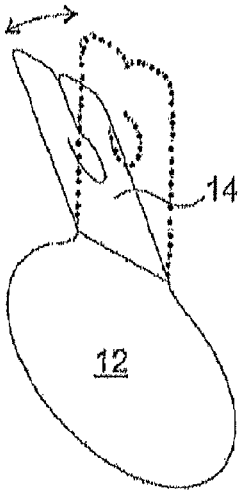
FIG. 2 is a perspective view of the hinge action of the decoration hanger of FIG. 1.

The presence of the difference in stiffness across the border 16 between the reinforced clamp portion 14 and the mounting portion 12 creates a natural film hinge between the two portions. This allows the hanger to deform in use (as shown in FIG. 2) to accommodate different sizes of balloons and other decorations. Furthermore, it allows the balloon to move when mounted which can be aesthetically pleasing. The tongue also flexes in use to supplement this movement because the plastics material layer laminated to the film plastics material is only semi-rigid.

Figure 5:
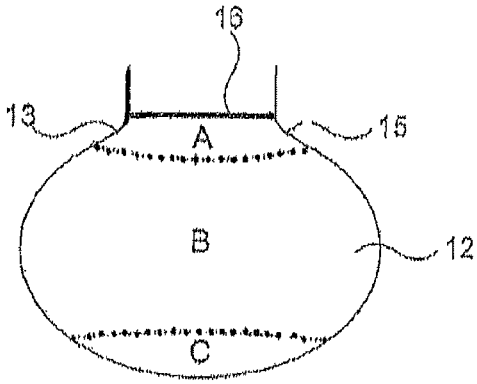
FIG. 5 is a top view of the mounting portion of the decoration hanger of FIG. 1.

Turning to FIG. 5 it can be seen that the elliptical mounting portion 12 comprises three zones A, B, C. Zone A comprises shoulders 13, 15 and is relatively small in width W. This helps the film hinge action. Zone B has a much larger width W which prevents unintentional peel-off in use. Zone C is smaller in width (the same as zone A) which assists intentional peel-off once zone B has been removed.

Figure 12:
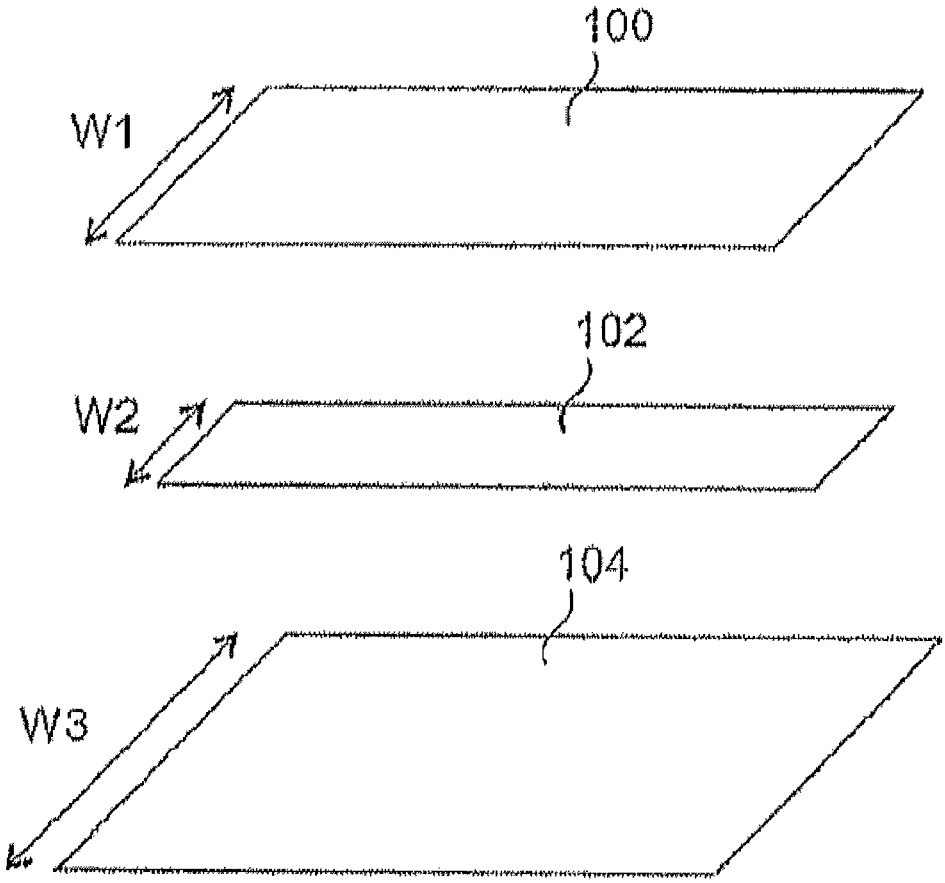
FIG. 12 is a perspective view of a first stage of the manufacturing process for the decoration hanger of FIG. 1.
Figure 13A:
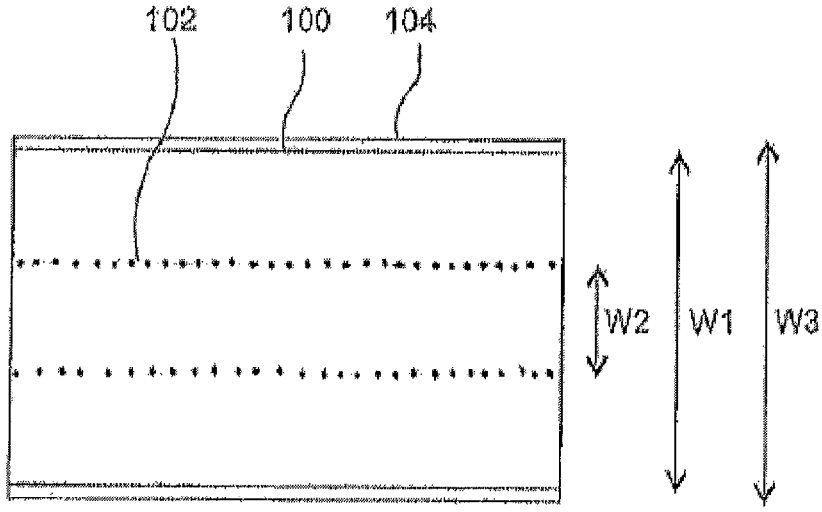
FIG. 13*a* is a plan view of a second stage of the manufacturing process for the decoration hanger of FIG. 1.
Figure 13B:
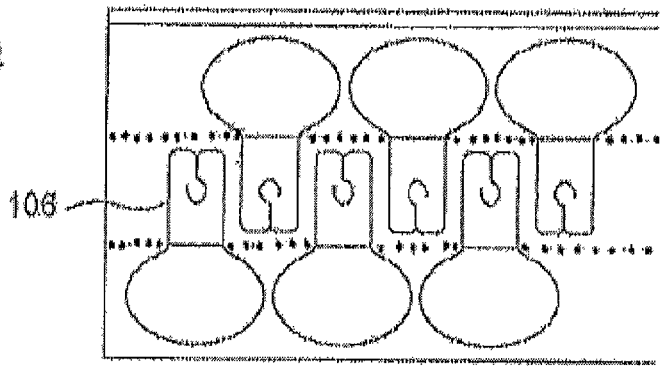
FIG. 13*b* is a plan view of a third stage of the manufacturing process for the decoration hanger of FIG. 1.
Figure 13C:
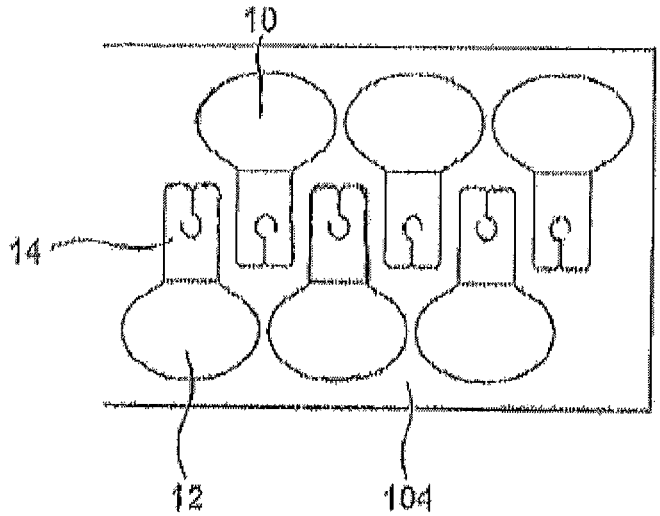
FIG. 13*c* is a plan view of a fourth stage of the manufacturing process for the decoration hanger of FIG. 1.

The hanger is manufactured as follows (with reference to FIGS. 12-13*c*):

i) A roll of film 100 having a low tack adhesive applied to a first side is provided, having a first width W1;

ii) A roll of stiffening material 102, stiffer than the film (e.g. a thicker plastic, or card) is provided, having a second width W2 less than the first width. Preferably the stiffening material has an affinity to the adhesive of the film;

iii) A roll of release paper 104 is provided, which is a flexible film coated with a release material (e.g. silicone) permitting easy release from the low tack adhesive is provided. The release paper has a third width W3 larger than the first width;

iv) The three materials 100, 102, 104 are laminated together in the above order with the roll of film and the backing material sandwiching the stiffening material as shown in FIG. 13*a*. The resulting product has a central band of reinforced stiffening material 102 separating the roll of adhesive film and the backing material;

v) A cutting tool, such as a rotary drum cutter or formed steel rule tool (not shown) is used to cut out an outer profile 106 of the hanger 10 as shown in FIG. 13*b*. The cutter approaches the laminated sheet from the adhesive film 102 side and does not fully penetrate the backing material 104. The cutting profile 106 is arranged such that the outline of the clamp portion 14 lies on the stiffening material 102, and the mounting portion 12 lies on the area where the adhesive film 100 is laminated to the backing material 104 only;

vi) The excess adhesive film material 100 and stiffening material 102 surrounding the cut hangers 10 is discarded, leaving a series of hangers 10 removably attached to the backing material 104 as shown in FIG. 13*c*.

Therefore, in summary, the hanger is manufactured by providing an adhesive-backed film material 100, affixing the reinforced semi-rigid plastic component 102 to the film 100 in the region that will become the clamp portion 14, cutting the film material to form the mounting portion 12 and the clamp portion 14, cutting the clamp portion 14 to form the mouth 29 and the tongue 30 formed from mouth material 102. The two cutting processes are completed simultaneously. The adhesive-backed film material is supplied with a backing sheet 104 from which the hangers can be peeled by a user.

Figure 6:
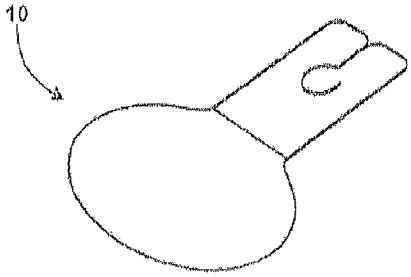
FIG. 6 is a perspective view of the decoration hanger of FIG. 1.
Figure 7:
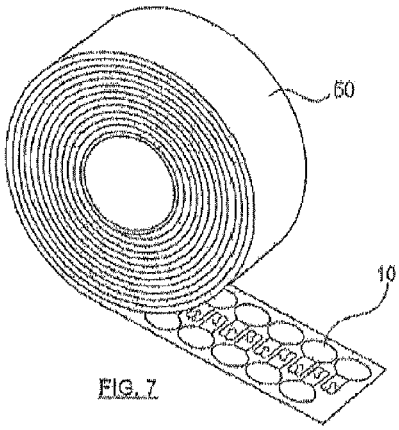
FIG. 7 is a perspective view of a roll of decoration hangers of FIG. 1.
Figure 8:
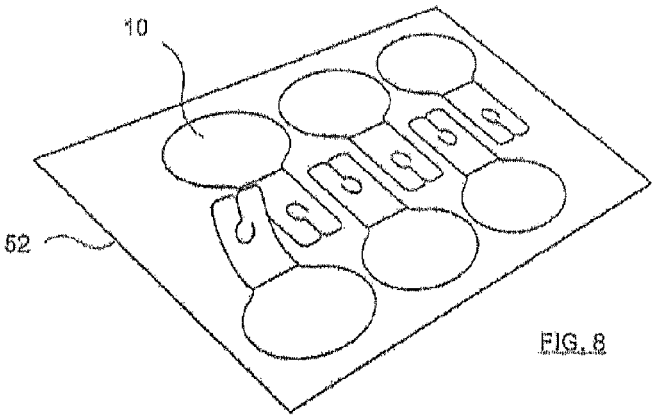
FIG. 8 is a perspective view of a sheet of decoration hangers of FIG. 1.
Figure 9:
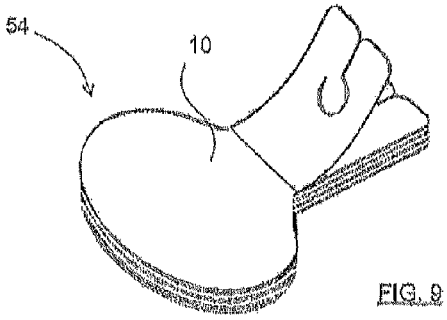
FIG. 9 is a perspective view of a pad of decoration hangers of FIG. 1.

FIGS. 6 to 9 show various configurations of decoration hanger dispensing methods. FIG. 6 shows a single hanger 10. FIG. 7 shows a roll 50 of hangers 10. FIG. 8 shows a peelable backing sheet 52 of hangers 10. FIG. 9 shows a booklet 54 of hangers 10.

While various embodiments of decoration hangers and methods for using and manufacturing the same have been described in considerable detail herein, the embodiments are merely offered by way of non-limiting examples of the disclosure described herein. It will therefore be understood that various changes and modifications may be made, and equivalents may be substituted for elements thereof, without departing from the scope of the disclosure. Indeed, this disclosure is not intended to be exhaustive or to limit the scope of the disclosure.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

We claim:

1. A decoration hanger, comprising:

a mounting portion having an adhering surface;

a clamp portion attached to the mounting portion, wherein the clamp portion has a higher flexural stiffness than the mounting portion and the clamp portion comprises a mouth configured to receive a part of a decoration; and a first sheet of material, in which the clamp portion is laminated with a second sheet of material, wherein the first sheet of material comprises a film having an adhesive applied to a first side and the second sheet of material is laminated to the first side of the film on the clamping portion leaving the adhesive of the mounting portion exposed.

2. A decoration hanger according to claim 1 in which the clamp portion is thicker than the mounting portion.

3. A decoration hanger according to a claim 1 in which the clamp portion comprises a tongue resiliently biased towards the mouth to retain the part of a decoration in use.

4. A decoration hanger according to claim 3 in which the clamp portion is generally planar and the tongue is movable out of, and resiliently biased towards, a plane of the clamp portion.

5. A decoration hanger according to claim 1 in which the mouth comprises a slit running from an edge of the mounting portion to an orifice configured to receive a part of a decoration.

6. A decoration hanger according to claim 5 in which the tongue is formed from material cut to form the orifice.

7. A decoration hanger according to claim 6 in which the orifice has a curved perimeter.

8. A decoration hanger according to claim 7 in which the curved perimeter runs from the slit through at least a 90 degree angle.

9. A decoration hanger according to claim 8 in which the curved perimeter runs from the slit through an approximately 270 degree angle.

10. A decoration hanger according to claim 5 in which the slit and the edge are joined by opposed curved edge portions.

11. A decoration hanger according to claim 1 comprising a film hinge between the mounting portion and the clamp portion.

* * * * *